US007100589B2

(12) United States Patent
Toriyama

(10) Patent No.: US 7,100,589 B2
(45) Date of Patent: Sep. 5, 2006

(54) MULTI-SPARK TYPE IGNITION SYSTEM

(75) Inventor: Makoto Toriyama, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/139,659

(22) Filed: May 31, 2005

(65) Prior Publication Data

US 2005/0263144 A1 Dec. 1, 2005

(30) Foreign Application Priority Data

May 28, 2004 (JP) ..... 2004-159012
Jan. 11, 2005 (JP) ..... 2005-004123

(51) Int. Cl.
*F02P 15/10* (2006.01)
*F02P 3/06* (2006.01)

(52) U.S. Cl. ..... 123/604; 123/605; 123/608

(58) Field of Classification Search ..... 123/604–608, 123/637; 315/209 T, 209 CD, 223, 224
See application file for complete search history.

(56) References Cited

U.S. PATENT DOCUMENTS 4,344,395 A * 8/1982 Kondo et al. ..... 123/406.57
4,441,478 A * 4/1984 Fujimoto ..... 123/406.57
4,462,363 A * 7/1984 Nanjyo et al. ..... 123/406.56
4,892,080 A 1/1990 Morino et al. ..... 123/604
4,922,883 A * 5/1990 Iwasaki ..... 123/598
5,056,496 A 10/1991 Morino et al. ..... 123/604
6,114,797 A * 9/2000 Bishop et al. ..... 310/318
6,557,537 B1 * 5/2003 Ikeda et al. ..... 123/606

FOREIGN PATENT DOCUMENTS

JP 6-330836 11/1994
JP 2002-221133 8/2002

* cited by examiner

*Primary Examiner*—John T. Kwon
(74) *Attorney, Agent, or Firm*—Nixon & Vanderhye P.C.

(57) ABSTRACT

A multi-spark type ignition system for an internal combustion engine has a compact energy storage coil. The multi-spark type ignition system includes a energy storage coil, an energy storage capacitor, a first power transistor that switches on or off supply of electric energy from a battery and the electric energy from the energy storage coil to the energy storage capacitor, a second power transistor connected to the energy storage capacitor and to an ignition coil and an external resistor, connected between the energy storage coil and the first power transistor so as to bypass the energy storage capacitor. The second power transistor switches on or off the primary current. The external resistor limits current flowing through the first power transistor, thereby limiting temperature rise of the first power transistor.

9 Claims, 2 Drawing Sheets

IGW
a1
a2

IGt (n)
b1
b2

Tr20

Tr40 ie
D
B
C i1 i2

MULTI-SPARK TYPE IGNITION SYSTEM

CROSS REFERENCE TO RELATED APPLICATION

The present application is based on and claims priority from Japanese Patent Applications: 2004-159012, filed May 28, 2004; and 2005-4123, filed Jan. 11, 2005; the contents of which are incorporated herein by reference.

BACKGROUND OF THE INVENTION

1. Field of the Invention

The present invention relates to an ignition system for a vehicle internal combustion engine, and, particularly, a multi-spark type ignition system that repeatedly ignites fuel each time it is supplied to each cylinder of an internal combustion engine.

2. Description of the Related Art

U.S. Pat. Nos. 4,892,080 and 5,056,496 disclose multi-spark type ignition systems in which as many ignition coils as cylinders of an internal combustion engine are employed. Such a system also includes an energy storage coil, a energy storage capacitor and switching power transistors for intermittently controlling supply of electric energy. One of the switching transistors switches on or off current flowing through the energy storage coil according to ignition timing signals. Because the energy storage coil supplies energy to all the ignition coils, a considerably large amount of electric current flows through the energy storage coil. Therefore, the resistance of the energy storage coil is required to be very low in order to prevent the temperature of the energy storage coil from excessively rising due to Joule heat.

However, if the power transistor is kept turn on due to some failure, the power transistor may be heated more as the resistance of the energy storage coil becomes smaller because the current flowing through the power transistor can not be suitably limited. Therefore, it was necessary to limit the electric current to prevent temperature rise the power transistor while maintaining the coil stored energy by increasing the number of turns thereof and to increase the size of the energy storage coil in order to increase heat radiation thereof.

SUMMARY OF THE INVENTION

Therefore, an object of the invention is to provide a multi-spark ignition system that has a compact energy storage coil whose temperature rise can be limited or controlled.

Another object of the invention is to provide a multi-spark ignition system in which the temperature of the power transistor is also prevented from excessively rising even if the power transistor is locked into a turning-on state by accident.

According to a preferred embodiment of the invention, a multi-spark type ignition system for an internal combustion engine includes an electric power source, a energy storage coil connected to the electric power source for storing electric energy supplied by the electric power source, an energy storage capacitor for storing electric energy discharged from the energy storage coil, a first switching element for switching on or off supply of the electric energy from the electric power source and supply from the energy storage coil to the energy storage capacitor, an ignition coil connected to the energy storage capacitor, a second switching element for switching on or off supply of the electric energy from the energy storage capacitor, and an external resistor connected between the energy storage coil and the first transistor so as to bypass the energy storage capacitor, thereby limiting current flowing through the first transistor. Therefore, the energy to be stored by the energy storage coil can be kept without increasing the number of turns thereof or the size thereof, while current flowing through the first switching element can be appropriately limited by the external resistor.

The above multi-spark ignition system may include a backflow preventing diode between the energy storage coil and the energy storage capacitor. The external resistor is preferably disposed separately from the energy storage coil. The external resistor may be disposed on a circuit board, which may be a ceramic circuit board. The external resistor may have a larger resistance than an internal resistance of the energy storage coil. The energy storage capacitor may have a high side terminal connected between the energy storage coil and the external resistor.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

A preferred embodiment of the invention will be described with reference to the appended drawings.

Figure 1:
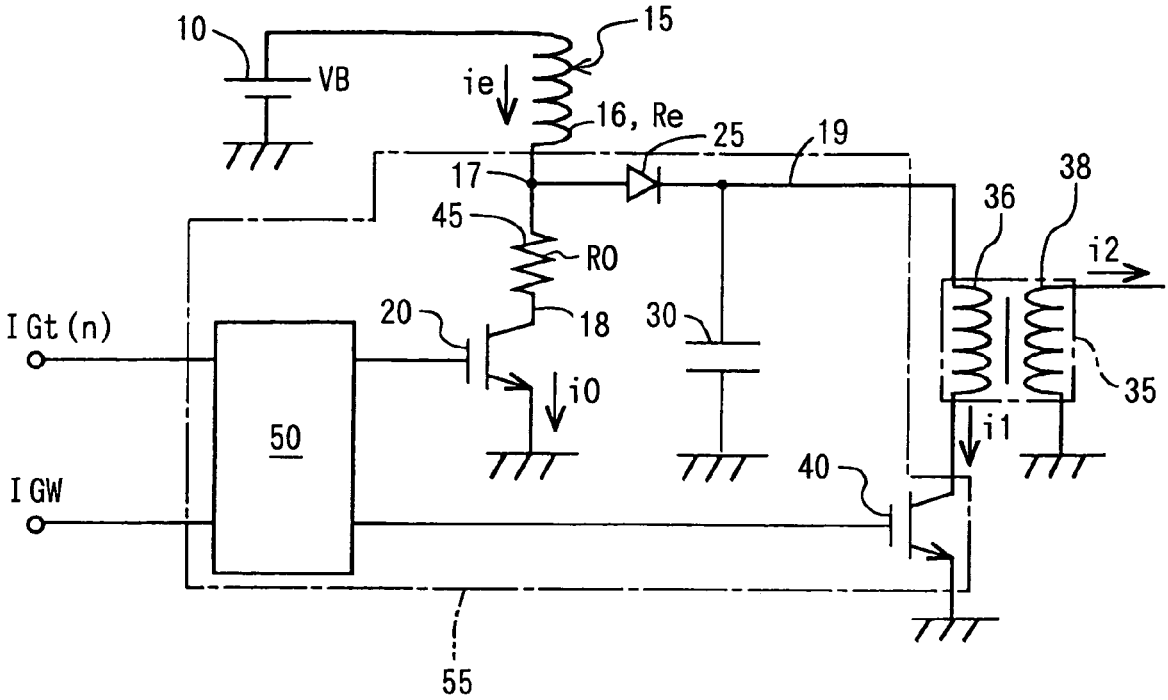
FIG. 1 is a circuit diagram of a multi-spark type ignition system according to a preferred embodiment of the invention.

As shown in FIG. 1, a vehicle battery 10, a multi-spark type ignition system includes a energy storage coil 15, a first power transistor (hereinafter referred to as the first transistor) 20, an energy storage capacitor 30, an ignition coil 35, a second power transistor (hereinafter referred to as the second transistor) 40, an external resistor 45 and a multi-spark control circuit 50. Incidentally, there are as many ignition coils 35 and the second transistors 40 as cylinders of an engine to which this system is applied. Each ignition coil 35 has a primary coil 36 and a secondary coil 38.

The energy storage coil 15 has an input terminal connected to a high-side terminal of the vehicle battery 10 and an output terminal 17 connected to one end of the external resistor 45. The other end of the external resistor 45 is connected to the collector 18 of the first transistor 20. In other words, the external resistor 45 is connected to the energy storage coil 15 so as to bypass the energy storage capacitor 30 and to limit current flowing through the first transistor 20. The energy storage coil 15 has a winding wire 16 that has an internal resistance Re, and the external resistor 45 has a resistance R0. The output terminal 17 of the energy storage coil 15 is also connected to the anode of a backflow preventing diode 25, whose cathode is connected to the high-side terminal of the energy storage capacitor 30 and to one end of the primary coil 36. The backflow preventing diode 25 prevents backflow of current from the capacitor 30 to the energy storage coil 15. The other end of the primary coil 36 is connected to the collector of the second transistor 40, whose emitter is grounded and whose base is connected to an output terminal of the multi-spark control circuit 50. One end of the secondary coil 38 of the ignition coil 35 is connected to one of spark plugs mounted on the engine (not shown), and the other end thereof is grounded.

The energy storage coil 15 is accommodated in a metal case, and the first transistor 20, the capacitor 30, the second transistor 40 and the external resistor 45 are respectively mounted on a heat conductive ceramic circuit board 55.

Figures 2A, 2B, 2C, 2D, 2E, 2F, 2G:
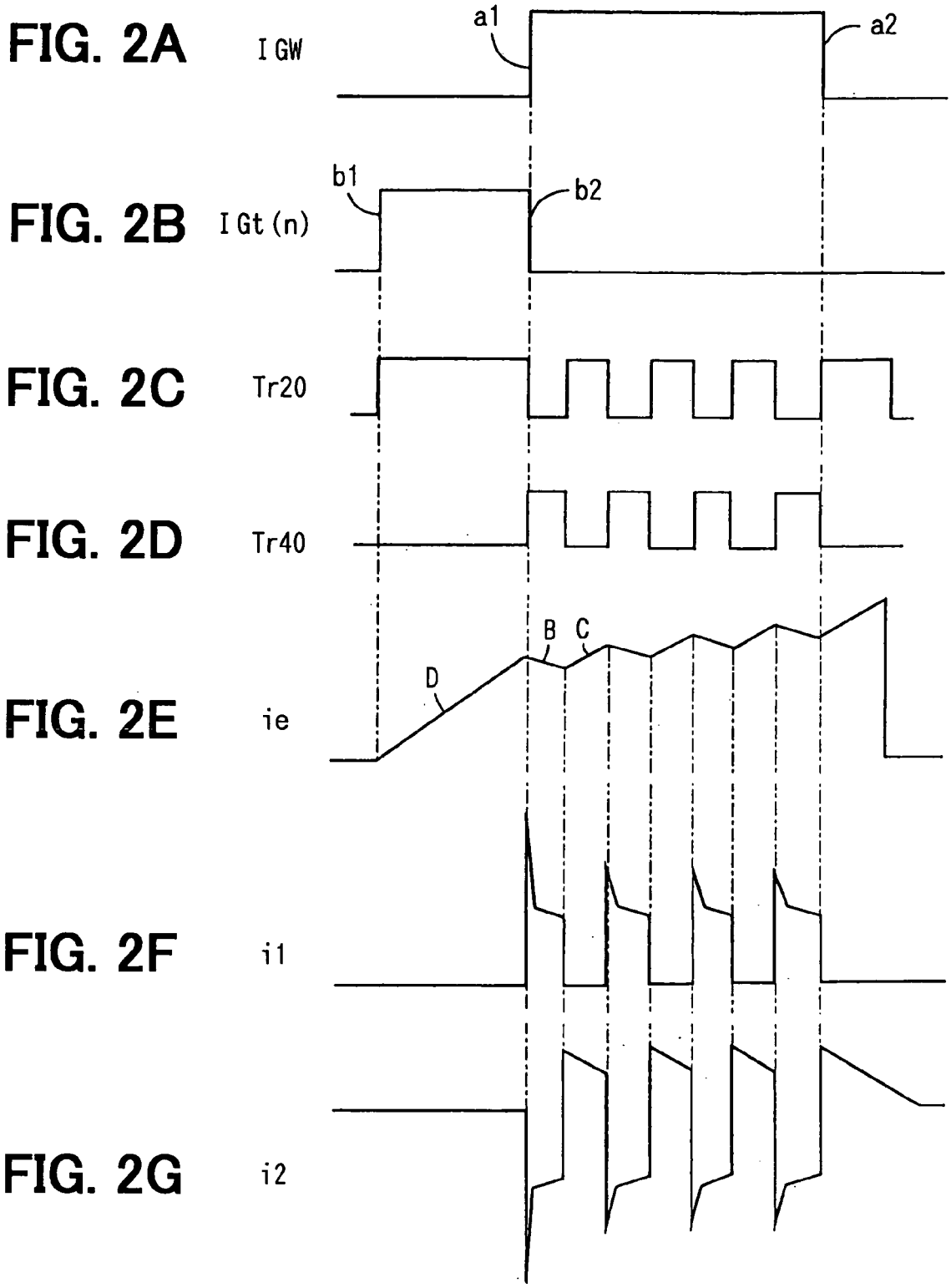
FIGS. 2A–2G show timings of signals at various portions of the ignition system according to the preferred embodiment of the invention.

A ignition period control signal IGW is applied to a first input terminal of the multi-spark control circuit 50 and an ignition timing signal IGt(n) is applied to a second input terminal of the control circuit 50. As shown in FIG. 2A, the ignition period control signal has a rising edge a1 and a falling edge a2, and the ignition timing signal IGt(n) has a rising edge b1 and a falling edge b2. The first transistor 20 turns on at the rising edge b1 of the ignition timing signal IGt(n), and the current ie that flows through the energy storage coil 15 gradually increases, as shown in FIGS. 2B and 2E.

The ignition timing signal IGt(n) falls down at an ignition timing, where the ignition period control signal IGW rises up to make the control circuit 50 repeatedly turn off and on the first transistor 20 and synchronously turn on and off one of the second transistor 40 for an nth cylinder as shown in FIGS. 2C and 2D. As a result, electric energy of the battery 10 is repeatedly accumulated in the energy storage coil 15 as shown in FIG. 2E, the electric energy accumulated in the energy storage coil 15 is repeatedly transferred to the energy storage capacitor 30 as an electric charge, and the electric charge charged by the capacitor 30 is repeatedly supplied to the primary coil 36 of one of the ignition coils 35 for the nth cylinder. When the second transistor 40 turns on, primary current i1 is supplied to the primary coil 36 as shown in FIG. 2F. When the second transistor 40 turns off, a certain level of primary voltage is induced in the primary coil 36. Accordingly, the secondary coil 38 generates secondary current i2, as shown in FIG. 2G, which is supplied to the sparkplug for the nth cylinder.

Thus, the above operation is repeated until the ignition period control signal IGW falls down at the falling edge a2.

Figure 3A:
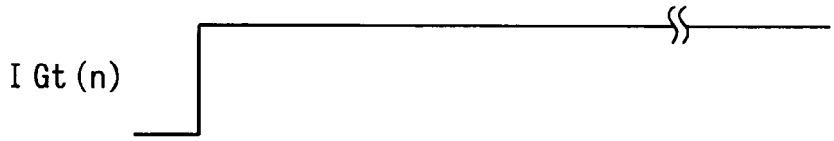
FIG. 3A–3C show time relationship between an ignition timing signal, current flowing through an energy storage coil and current flowing through a switching power transistor, which are included in the ignition system according to the preferred embodiment of the invention.
Figure 3B:
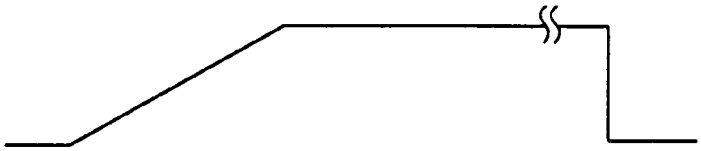
Figure 3C:
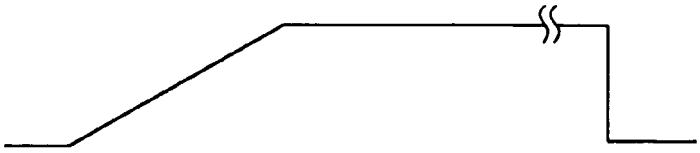

If the ignition timing signal IGt(n) keeps its high level for a preset time by accident, as shown in FIG. 3A, the current ie flowing through the energy storage coil 15 and the current i0 flowing through the first transistor 20 are monitored by current detecting resistors (not shown) and controlled to have lower levels, as shown in FIG. 3B and FIG. 3C.

When the timing period control signal IGW falls down at the falling edge a2, the multi-spark control circuit 50 turns on the first transistor 20, as shown in FIG. 2C. Therefore, the current ie flowing through the energy storage coil 15 increases as shown in FIG. 2E, and the energy stored by the coil 15 increases. The multi-spark control circuit 50 monitors the current i0 flowing through the emitter of the first transistor 20 until it increases and becomes a suitable preset value, at which the multi-spark control circuit 50 turns off the first transistor 20 to supply the capacitor 30 with a sufficient amount of the energy accumulated by the energy storage coil 15 whose internal resistance can be made as small as possible. This smaller internal resistance reduces Joule heat generated in the energy storage coil 15. In other words, the amount of the current ie flowing through the energy storage coil 15 can be increased to reduce the number of turn, so that the size of the energy storage coil can be reduced.

In the period in which the ignition timing signal IGt(n) rises up until it rises down, the power consumption P of the first transistor 20 is expressed as follows: $P=i0\times(VB-ie\times(Re+R0)$, wherein VB is a battery voltage. The current i0 is suitably limited by the external resistor 45 so that the first transistor 20 can be prevented from being overheated due to Joule heat.

Incidentally, the power loss of the external resistor 45 is not so significant because the primary current i1 does not flow through it. Because the external resistor 45 is disposed on a heat conductive ceramic board, it can be sufficiently cooled.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A multi-spark type ignition system for an internal combustion engine comprising:

an electric power source;

a energy storage coil connected to said electric power source for storing electric energy supplied by said electric power source;

an energy storage capacitor, connected to said energy storage coil, for storing electric energy discharged from said energy storage coil;

a first switching element, connected to said energy storage coil and said electric power source, for switching on or off supply of the electric energy from said electric power source and from said energy storage coil to said energy storage capacitor;

an ignition coil connected to said energy storage capacitor;

a second switching element, connected between said energy storage capacitor and said ignition coil, for switching on or off supply of the electric energy from said energy storage capacitor; and an external resistor, connected between said energy storage coil and said first transistor so as to bypass said energy storage capacitor, for limiting current flowing through said first transistor.

2. The multi-spark ignition system as claimed in claim 1 further comprising a backflow preventing diode having an anode connected to said energy storage coil and to said external resistor and a cathode connected to said energy storage capacitor and to said primary coil.

3. The multi-spark ignition system as claimed in claim 1, wherein said external resistor is disposed separately from said energy storage coil.

4. The multi-spark ignition system as claimed in claim 3 further comprising a circuit board separate from said energy storage coil, wherein said external resistor is disposed on said circuit board.

5. The multi-spark ignition system as claimed in claim 4, wherein said circuit board is a ceramic circuit board.

6. The multi-spark ignition system as claimed in claim 1, wherein said external resistor has a larger resistance than an internal resistance of said energy storage coil.

7. The multi-spark ignition system as claimed in claim 1, wherein said energy storage capacitor has a high side terminal connected between said energy storage coil and said external resistor.

8. The multi-spark ignition system as claimed in claim 1, further comprising a control circuit for cyclically providing said first switching element with ignition period control signals and said second switching element with ignition timing signals.

9. A multi-spark type ignition system for an internal combustion engine comprising:

a battery having one end for supplying electric energy and the other end connected to a ground;

a energy storage coil having one end connected to the one end of said battery and the other end for discharging electric energy;

an energy storage capacitor having one end connected to the other end of said energy storage coil and the other end for storing electric energy discharged from said energy storage coil;

a first power transistor connected between said battery and said first switching element, for switching on or off supply of the electric energy from said battery and the electric energy from said energy storage coil to said energy storage capacitor;

an ignition coil having one end connected to the one end of said energy storage capacitor and the other end for supplying primary current;

a second switching element, connected to the one end of said energy storage capacitor and to the other end of said ignition coil, for switching on or off the primary current; and an external resistor, connected between said energy storage coil and said first transistor so as to bypass said energy storage capacitor, for limiting current flowing through said first transistor.

* * * * *